United States Patent [19]

Tucker

[11] 4,100,752

[45] Jul. 18, 1978

[54] SUBSEA RISER SYSTEM

[75] Inventor: Albert R. Tucker, Spring, Tex.

[73] Assignee: FMC Corporation, San Jose, Calif.

[21] Appl. No.: 723,380

[22] Filed: Sep. 15, 1976

[51] Int. Cl.[2] ..... E02B 17/00

[52] U.S. Cl. ..... 61/86; 61/95; 61/111; 9/8 P; 166/5

[58] Field of Search ..... 61/86, 94, 95, 97, 98, 61/110, 111; 166/0.5, 0.6; 285/181; 141/387; 9/8 P

[56] References Cited

U.S. PATENT DOCUMENTS

| | | | |
|---|---|---|---|
| 2,269,431 | 1/1942 | Allen et al. | 285/181 X |
| 2,731,234 | 1/1956 | Bily | 285/181 X |
| 3,196,958 | 7/1965 | Travers et al. | 175/7 |
| 3,359,741 | 12/1967 | Nelson | 166/0.5 |
| 3,500,904 | 3/1970 | Watkins et al. | 166/0.5 |
| 3,551,005 | 12/1970 | Brun | 166/0.5 |
| 3,605,413 | 9/1971 | Morgan | 166/0.5 X |

*Primary Examiner*—Jacob Shapiro
*Attorney, Agent, or Firm*—W. W. Ritt, Jr.

[57] ABSTRACT

A subsea riser system for conducting petroleum or other fluid from the ocean floor to a floating loading and storage terminal or other facility at the water surface. The bottom end of the riser is connected to a subsea base by a hydraulic connector, and the lower portion of the riser is supported in tension between the subsea base and a submerged tension leg platform. The portion of the riser between the submerged platform and the floating terminal is flexible to accommodate relative movement between the platform and terminal, this flexibility accomplished by means of a series of pipe swivel joints spaced along the riser.

13 Claims, 4 Drawing Figures

SUBSEA RISER SYSTEM

BACKGROUND OF THE INVENTION

This invention relates to underwater petroleum production, and more particularly to apparatus for conducting petroleum and other fluids from a subsea base to a storage or loading facility at the water surface. The invention especially pertains to riser pipe systems between a location on the ocean floor and a terminal on a floating production platform.

In the production of crude oil and other petroleum fluids from an underwater well, a floating platform containing equipment for storing the produced fluids or for transferring these fluids to a marine tanker or other transport vessel is often used at the water surface. Although these floating platforms are securely anchored in position over the underwater well, the surface effects of wind, waves, and water currents cause some movement of the platform, and in areas such as the North Sea where these surface conditions frequently are very severe the extent of platform movement can be quite significant.

Because of this problem, it has been difficult to establish and maintain an adequate conduit system to conduct the petroleum from the underwater wellhead to the platform, and especially to provide such a conduit, or riser system as it is termed in the industry, that will withstand the movements of the platform during severe weather conditions.

Another problem particularly related to the deeper offshore areas of petroleum production is that the use of divers to assist in the installation and maintenance of underwater well equipment is very expensive, and the efficiency of diver activity at great depths is very low.

SUMMARY OF THE INVENTION

The present invention solves the foregoing and other problems by providing a new type of riser system for interconnecting an underwater well with a production or other platform floating on the water's surface. The riser system includes a lower section or portion that extends upward from a subsea base located on the ocean floor to a submerged tension leg platform located at a depth such as 275 to 300 feet where divers can be utilized with reasonable efficiency and expense, an intermediate or middle section that extends from the submerged platform to the bottom of the floating surface platform, and an upper section that extends up through the diving shaft or other passageway in the platform to an above-water level where it is connected into the conduit system leading to the facilities for storing the product or loading it into a marine tanker or other transport vessel.

The lower section of the riser is supported in tension between the submerged platform and the subsea base, and comprises a series of pipe lengths joined together by a suitable manually operated pipe connector. The bottom end of this lower riser section is connected to the subsea base by a suitable hydraulically operated riser connector, and a pipe ball joint is located in this lower riser section, preferably just above the hydraulic connector, to allow for slight lateral movement of this lower section with respect to the base.

The submerged platform is provided with positive buoyancy, and is secured to the subsea base by tension legs, such as cables of appropriate size and strength.

The intermediate or middle riser section is comprised of a series of pipe lengths joined end-to-end by pipe swivel joint assemblies, each assembly preferably comprising two joints disposed on mutually perpendicular axes, so that this middle riser is flexible and therefore capable of compensating for movement of the floating platform. The length of the middle riser is substantially greater than the distance between the bottom of the floating platform and the top of the submerged platform, to facilitate accommodation of great changes in this distance that may occur especially during hostile surface conditions. The lower end of the middle riser is connected at the submerged platform to the upper end of the lower riser by a hydraulic operated connector.

The upper riser section is generally of the same construction as the lower section, that is a plurality of pipe lengths connected end-to-end by manual pipe connectors, and is suspended in the diving shaft or other passageway in the platform to its connection at the platform bottom to the upper end of the middle riser section.

The middle riser section can be provided with flotation means to impart a desired degree of buoyancy thereto, such as a coating or outer shell of flotation material. This helps to relieve the load imparted by this middle riser on its connection to the upper riser at the floating platform.

Accordingly, one object of the present invention is to provide a new type of riser system for interconnecting a subsea wellhead or other subsea base with a floating surface platform.

Another object of the present invention is to provide a new subsea riser system that will accommodate a great degree of movement of a surface floating platform from its normal location over a subsea well or station, without jeopardizing the integrity of the riser system.

Yet another object of the present invention is to provide a flexible offshore riser system that can be installed at great depths to a subsea base without diver assistance, and that provides for efficient diver installation and maintenance at shallower levels.

Still another object of the present invention is to provide an improved subsea riser system that can be employed at all offshore locations regardless of water depths or surface weather and water conditions.

Further objects and advantages of the present invention will become apparent from the following description, including the accompanying drawings.

DESCRIPTION OF THE PREFERRED EMBODIMENT

Figure 1A:
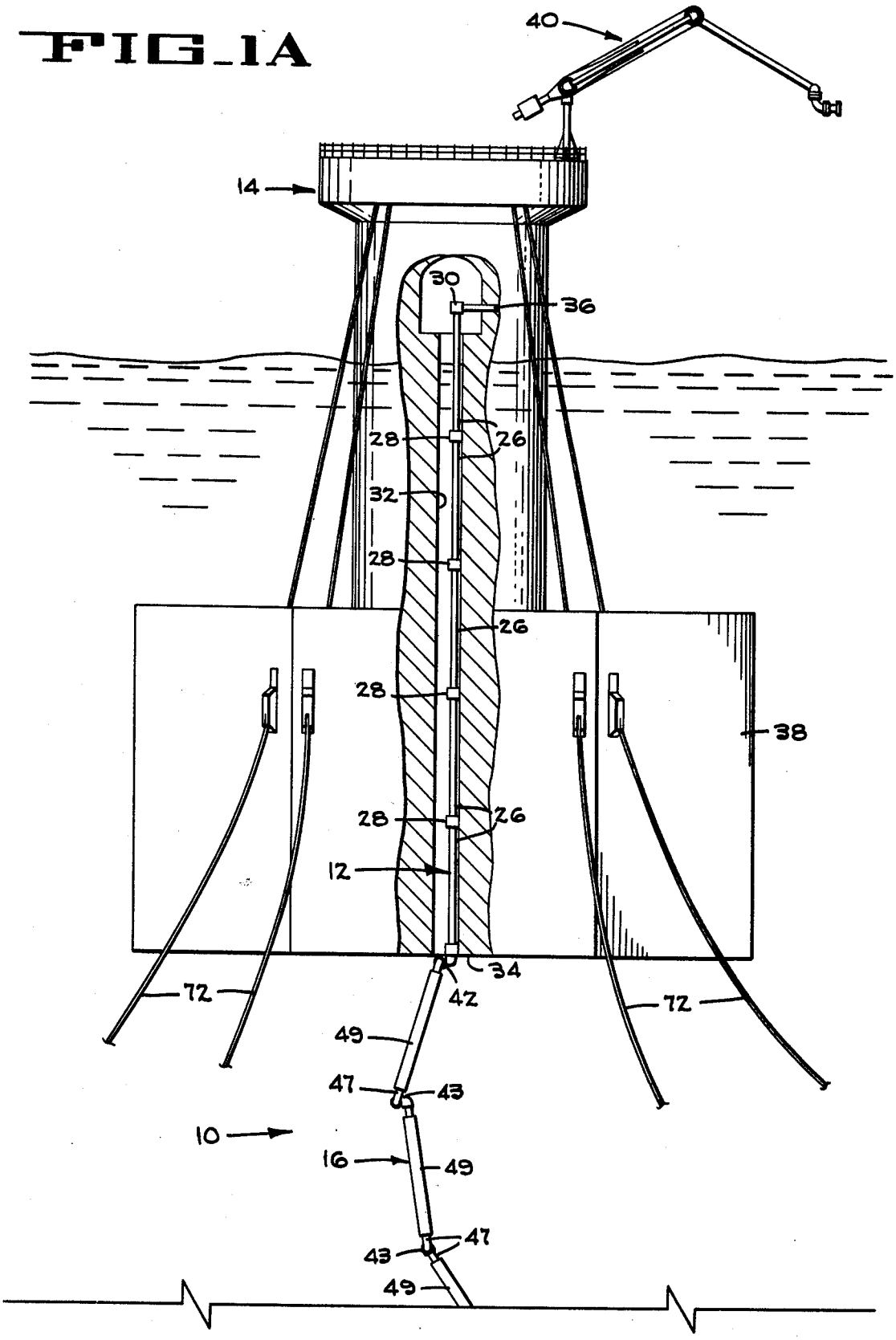
FIGS. 1A and 1B together constitute a diagrammatic view in elevation of a subsea riser system embodying the principles of the present invention.
Figure 1B:
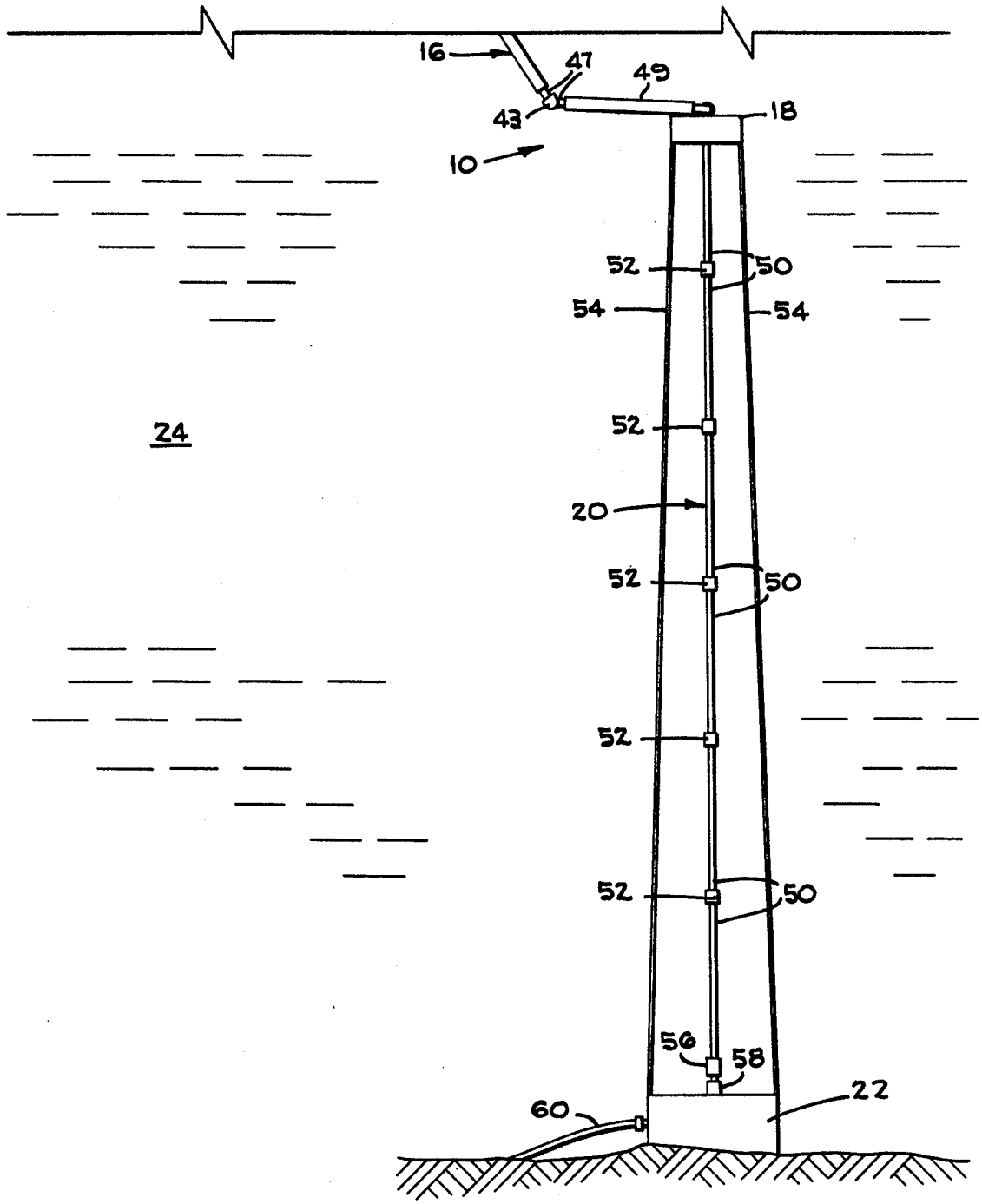

As illustrated in the drawings, a subsea riser system 10 according to the present invention comprises an upper riser section 12 supported from and extending downward in a floating offshore surface platform 14, an intermediate or middle riser section 16 connected to the bottom end of the upper riser section 12 and extending to a submerged platform 18, and a lower riser section 20 that extends between the submerged platform 18 and a subsea wellhead, manifold, or other subsea base 22 located on the floor of the ocean or other body of water 24.

The upper riser section 12 comprises a plurality of pipe lengths 26 joined in end-to-end manner by manually operated pipe connectors 28, and this riser section extends downwardly from a suitable above-water level in the platform 14, such as at the riser head 30, through the platform's diving shaft 32 or other suitable passageway to the bottom 34 of the platform. Preferably the lengths of riser pipe 26 are dimensioned to be easily handled on the platform, such as when installing or removing this upper riser section 12. This facilitates using known techniques to assemble these lengths as the upper riser is made up and lowered through the platform, such as by procedures akin to these employed to make up a drill string during well drilling operations.

The top end of the upper riser 12 is connected at the riser head 30 to a conduit system 36 that can lead to the platform's storage or reservoir facility 38, and/or to the equipment employed to transfer the produced fluid to a marine tanker or other transport vessel (not shown) such as a marine loading arm 40.

Figure 3:
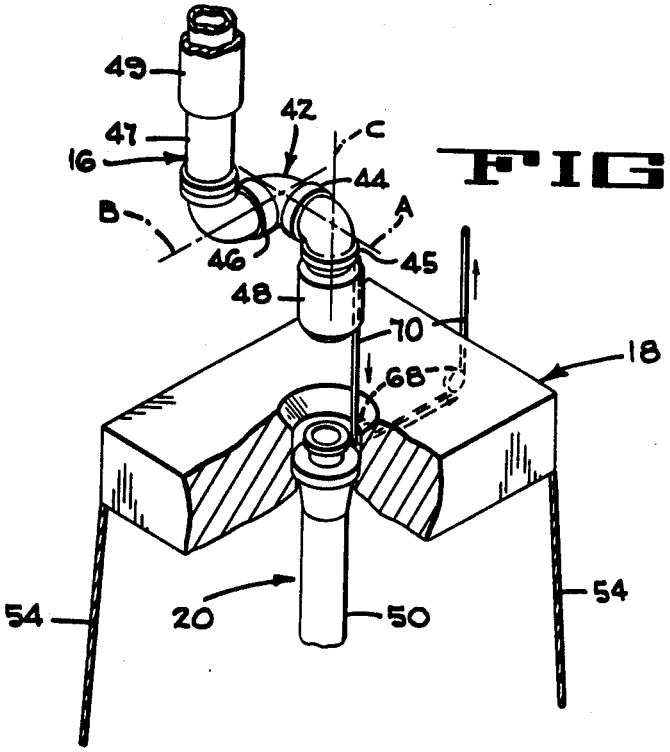
FIG. 3 is a diagrammatic fragmentary isometric view, partially broken away, of a submerged platform according to the present invention, showing the top end of a lower riser section supported thereon, and the bottom end of a middle riser section about to be connected thereto.

The bottom end of the upper riser 12 is connected to the top end of the middle riser 16 through a pipe swivel joint assembly 42 comprising three pipe swivel joints interconnected so that their axes are mutually perpendicular. A swivel joint assembly 43 comprising two swivel joints so that their axes are mutually perpendicular is employed to interconnect each of the pipe lengths of the middle riser 16. As best seen in FIG. 3, another swivel joint assembly 42, comprising individual swivel joints 44, 45, 46 oriented on mutually perpendicular axes A, B, and C, is employed to interconnect the lowest pipe length 47 of the middle riser 16 to a hydraulic operated pipe connector 48 for connecting this riser section to the top end of the lower riser 20 at the submerged platform 18. Thus, the middle riser 16 is flexible, and can readily accomodate all movements of the surface platform 14 as it responds to the conditions of wind, waves, and current.

In order to minimize the load imposed by the middle riser 16 on the bottom end of the upper riser 12, flotation means, such as buoyant covers or sheaths 49 can be included on the middle riser pipe lengths 47.

The lower riser 20 comprises a plurality of pipe lengths 50 interconnected by manually operated connectors 52, and is supported in tension by the buoyant submerged platform 18 that is secured to the subsea base by a plurality of tension legs 54, such as steel cables of proper dimension, strength, and composition. To facilitate slight movement of the lower riser 20 from a true vertical orientation, a pipe ball joint 56 is provided at the bottom of this lower riser just above a hydraulically operated riser connector 58 that is employed to connect the bottom end of the lower riser to a conduit 60 at the subsea base 22. Suitable valving, as represented by the valve 62, can be included in the conduit 60 if desired.

Figure 2:
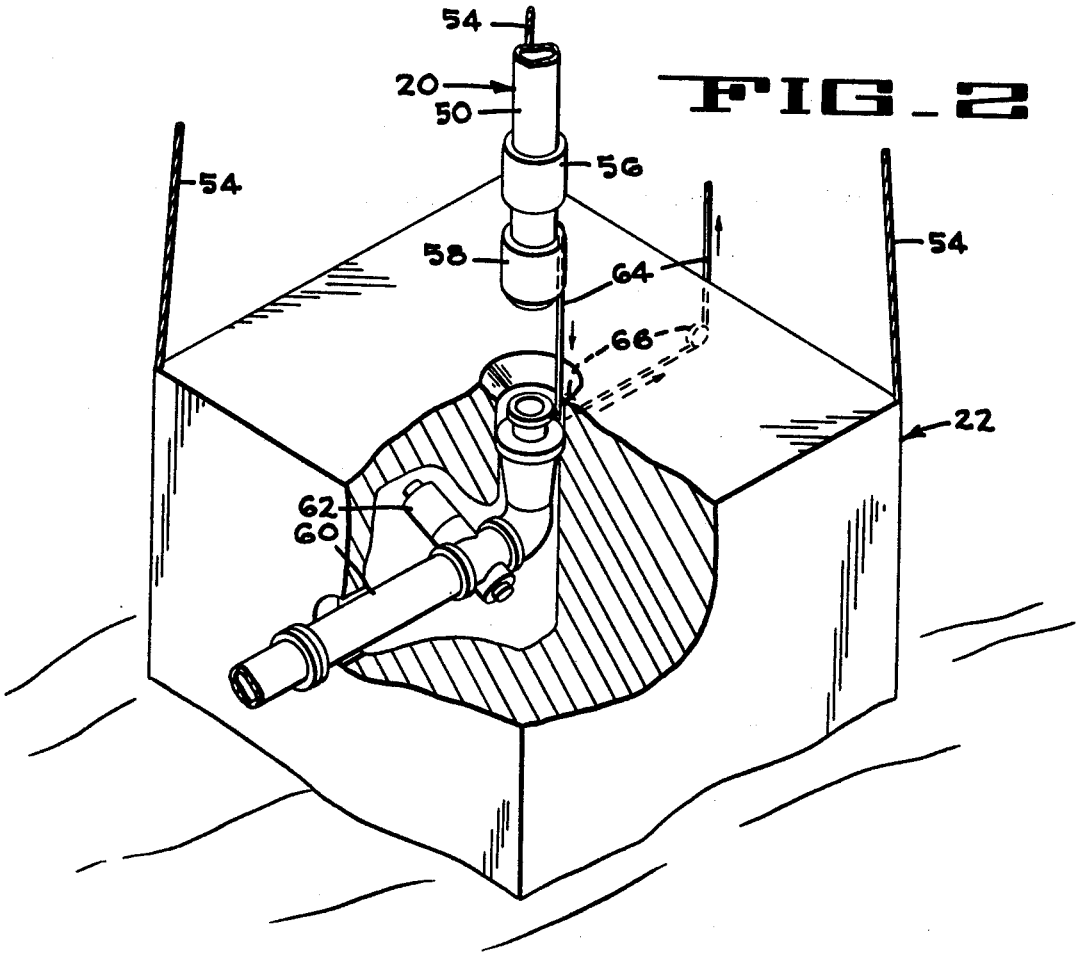
FIG. 2 is a diagrammatic fragmentary isometric view, partially broken away, of a subsea base and the bottom end of a riser being installed thereon, according to the present invention.

The lower riser 20 can be installed between the subsea base 22 and the submerged platform 18 by assembling this riser at the surface platform, and lowering it while pulling it to the subsea base by a winch and cable system that is controlled at the surface platform, such as is illustrated in FIG. 2 by the cable 64 and sheaves 66. The cable 64 can be attached to the hydraulic connector 58 and winched at the surface platform 14, thereby eliminating the need for diver assistance.

In like manner, the bottom end of the flexible middle riser 16 can be connected to the top end of the lower riser 20 by a system of sheaves 68 and cable 70, operated by a suitable winch, etc. (not shown) at the surface.

It should be noted that the two hydraulic connectors 48,58 not only facilitate installation of this subsea riser system without the need for diver assistance, these connectors also enable the system to be disconnected either at the submerged platform 18 or the subsea base 22 when desired. For example, in the event of a storm, disconnection can be achieved without diver assistance, and without damage to the system. Furthermore, if the platform anchor lines 72 are slipped, disconnection will prevent damage and will facilitate retrieval of the riser sections.

Although the best mode contemplated for carrying out the present invention has been herein shown and described it will be apparent that modification and variation may be made without departing from what is regarded to be the subject matter of the invention, as set forth in the appended claims.

I claim:

1. A subsea well production riser apparatus extending between an underwater production station and a production station located at the water surface, comprising (a) an upper riser section extending downwardly from a support thereof at the surface production station, (b) a lower riser section extending upwardly from the underwater production station to a submerged support for said lower section, said lower section being supported in tension with respect to said underwater station, (c) a middle riser section intermediate said upper and lower riser sections and interconnecting said two riser sections to establish a fluid flow conduit therewith, said middle riser section being flexible to accommodate movement of the surface production station with respect to the underwater station, and (d) a submerged platform means intermediate said surface production station and said underwater station, said submerged platform means being secured to an underwater foundation by means other than said lower riser section and having positive buoyancy.

2. An apparatus according to claim 1 wherein the middle riser section comprises a plurality of pipe lengths joined in end-to-end manner by plurality of pipe swivel joint assemblies.

3. An apparatus according to claim 2 wherein each pipe swivel joint assembly comprises at least two pipe swivel joints oriented on mutually perpendicular axes.

4. An apparatus according to claim 1 including flotation means associated with said middle riser section to impart a degree of buoyancy thereto.

5. An apparatus according to claim 1 wherein said lower riser section is supported on said submerged platform.

6. An apparatus according to claim 1 wherein said surface production station comprises an offshore floating platform, and said underwater station comprises a subsea flowline terminal.

7. A subsea well production riser apparatus extending between an underwater production station and a production station located at the water surface, comprising (a) an upper riser section extending downwardly from a support thereof at the surface production station, (b) a lower riser section extending upwardly from the underwater production station to a submerged support for said lower section, said lower section being supported in tension with respect to said underwater station, (c) a middle riser section intermediate said upper and lower riser sections and interconnecting said two riser sections to establish a fluid flow conduit therewith, said middle riser section being flexible to accommodate movement of the surface production station with respect to the underwater station, and (d) remotely controllable pipe connector means interconnecting said middle and lower riser sections.

8. A subsea well production riser apparatus extending between an underwater production station and a production station located at the water surface, comprising (a) an upper riser section extending downwardly from a support thereof at the surface production station, (b) a lower riser section extending upwardly from the underwater production station to a submerged support for said lower section, said lower section being supported in tension with respect to said underwater station, (c) a middle riser section intermediate said upper and lower riser sections and interconnecting said two riser sections to establish a fluid flow conduit therewith, said middle riser section being flexible to accommodate movement of the surface production station with respect to the underwater station, and (d) remotely controllable pipe connector means interconnecting said lower riser section and said underwater station.

9. A subsea well production riser apparatus extending between an underwater production station and a production station located at the water surface, comprising (a) an upper riser section extending downwardly from a support thereof at the surface production station, (b) a lower riser section extending upwardly from the underwater production station to a submerged support for said lower section, said lower section being supported in tension with respect to said underwater station, (c) a middle riser section intermediate said upper and lower riser sections and interconnecting said two riser sections to establish a fluid flow conduit therewith, said middle riser section being flexible to accommodate movement of the surface production station with respect to the underwater station, and (d) pipe ball joint means included in said lower riser section to accommodate lateral movement of said surface production station with respect to said underwater station.

10. A subsea well production riser apparatus extending between an underwater production station and a production station located at the water surface, comprising (a) an upper riser section extending downwardly from a support thereof at the surface production station, (b) a lower riser section extending upwardly from the underwater production station to a submerged support for said lower section, said lower section being supported in tension with respect to said underwater station, (c) a middle riser section intermediate said upper and lower riser sections and interconnecting said two riser sections to establish a fluid flow conduit therewith, said middle riser section being flexible to accommodate movement of the surface production station with respect to the underwater station, and (d) means for drawing said lower riser section down to said underwater station.

11. An apparatus according to claim 10 wherein said drawing means comprises a sheave and cable assembly extending between said surface and underwater stations.

12. A subsea well production riser apparatus extending between an underwater production station and a production station located at the water surface, comprising (a) an upper riser section extending downwardly from a support thereof at the surface production station, (b) a lower riser section extending upwardly from the underwater production station to a submerged support for said lower section, said lower section being supported in tension with respect to said underwater station, (c) a middle riser section intermediate said upper and lower riser sections and interconnecting said two riser sections to establish a fluid flow conduit therewith, said middle riser section being flexible to accommodate movement of the surface production station with respect to the underwater station, and (d) means for drawing the middle riser section to an intermediate underwater location wherein it can be connected to the lower riser section.

13. An apparatus according to claim 12 wherein said draw means comprises a sheave and cable assembly extending between said surface station and said intermediate underwater location.

* * * * *